US010072671B2

(12) United States Patent
Engert et al.

(10) Patent No.: US 10,072,671 B2
(45) Date of Patent: Sep. 11, 2018

(54) FAN DIFFUSER HAVING A CIRCULAR INLET AND A ROTATIONALLY ASYMMETRICAL OUTLET

(75) Inventors: Markus Engert, Lauda-Lönigshofen (DE); Erik Reichert, Boxberg (DE); Oliver Haaf, Kupferzell (DE); Christian Pfaff, Künzelsau (DE); Marc Schneider, Dörzbach (DE); Jürgen Schöne, Bad Mergentheim (DE); Katrin Bohl, Künzelsau (DE); Sven Beck, Krautheim (DE); Dieter Best, Ingelfingen (DE); Tobias Ehmann, Neuenstein (DE); Alexander Frank, Pfedelbach (DE); Erhard Gruber, Satteldorf (DE); Matthias Maschke, Kupferzell (DE); Thomas Sauer, Bad Mergentheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 852 days.

(21) Appl. No.: 13/994,238

(22) PCT Filed: Dec. 16, 2011

(86) PCT No.: PCT/EP2011/173090
§ 371 (c)(1),
(2), (4) Date: Jun. 14, 2013

(87) PCT Pub. No.: WO2012/084725
PCT Pub. Date: Jun. 28, 2012

(65) Prior Publication Data

US 2014/0086728 A1 Mar. 27, 2014

(30) Foreign Application Priority Data

Dec. 21, 2010 (DE) ..... 20 2010 016 820 U

(51) Int. Cl.
*F04D 29/54* (2006.01)
*F04D 29/66* (2006.01)
*F04D 19/00* (2006.01)

(52) U.S. Cl.
CPC ..... *F04D 29/541* (2013.01); *F04D 19/002* (2013.01); *F04D 29/547* (2013.01); *F04D 29/664* (2013.01); *F05D 2250/121* (2013.01)

(58) Field of Classification Search
CPC ..... F04D 29/44; F04D 29/54; F04D 29/541; F04D 29/545; F04D 29/547; F04D 29/66;
(Continued)

(56) References Cited

U.S. PATENT DOCUMENTS 1,940,790 A * 12/1933 Diehl ..... G01M 9/04 138/44
2,144,035 A * 1/1939 Smith, Jr. ..... F04D 29/545 415/148

(Continued)

FOREIGN PATENT DOCUMENTS

EP 0 581 978 A1 2/1994
EP 0 651 207 A1 5/1995

(Continued)

OTHER PUBLICATIONS

Joshua D'Souza, Aeolus Wind Energy Systems, Sep. 9, 2010, https://aeoluswindenergy.wordpress.com/page/2/.*
PCT International Search Report—dated Mar. 23, 2012.

*Primary Examiner* — Richard Edgar
*Assistant Examiner* — Danielle M Christensen
(74) *Attorney, Agent, or Firm* — Brinks Gilson & Lione

(57) ABSTRACT

A diffuser (3) for a fan (2) of axial, radial or diagonal type of construction, has an inlet opening (10) and having an outlet opening (20) for a gaseous medium which flows through a diffuser interior (I), which is enclosed by an outer housing (30), in an axially oriented main flow direction (S)
(Continued)

from the inlet opening (10) to the outlet opening (20). The cross section of the diffuser interior (I) increases from the cross section (11) of the inlet opening to the cross section (21) of the outlet opening (20), wherein the outer housing (30) forms an outer diffuser part (AD) which delimits the diffuser interior (I) to the outside. Along the main flow direction (S), the cross section of the outer diffuser part (AD) changes from a circular cross section (31) at the inlet opening (10) to a non-circular cross section (32) at the outlet opening (20).

19 Claims, 10 Drawing Sheets

(58) Field of Classification Search
CPC ..... F04D 29/64; F04D 29/441; F04D 29/661; F03D 1/04; F05D 2260/96
See application file for complete search history.

(56) References Cited

U.S. PATENT DOCUMENTS 4,077,206 A * 3/1978 Ayyagari ..... F02K 1/386 181/220
4,140,433 A * 2/1979 Eckel ..... F03D 1/04 290/55
5,355,417 A * 10/1994 Burdisso ..... G10K 11/1788 381/190
5,728,979 A * 3/1998 Yazici ..... F24F 7/08 181/224
6,375,416 B1 4/2002 Farrell et al.
2002/0015640 A1 * 2/2002 Nishiyama ..... F01P 11/12 415/119
2002/0112673 A1 * 8/2002 Lorton ..... A01K 1/0052 119/437
2005/0002783 A1 * 1/2005 Hiel ..... F03D 1/04 415/208.1
2006/0105696 A1 * 5/2006 Wenger ..... F24F 7/013 454/254
2012/0141266 A1 * 6/2012 Smyth ..... F03D 1/04 415/213.1

FOREIGN PATENT DOCUMENTS

FR 2 816 361 5/2002
WO WO 2010/046668 A1 4/2010

* cited by examiner

FIG. 7
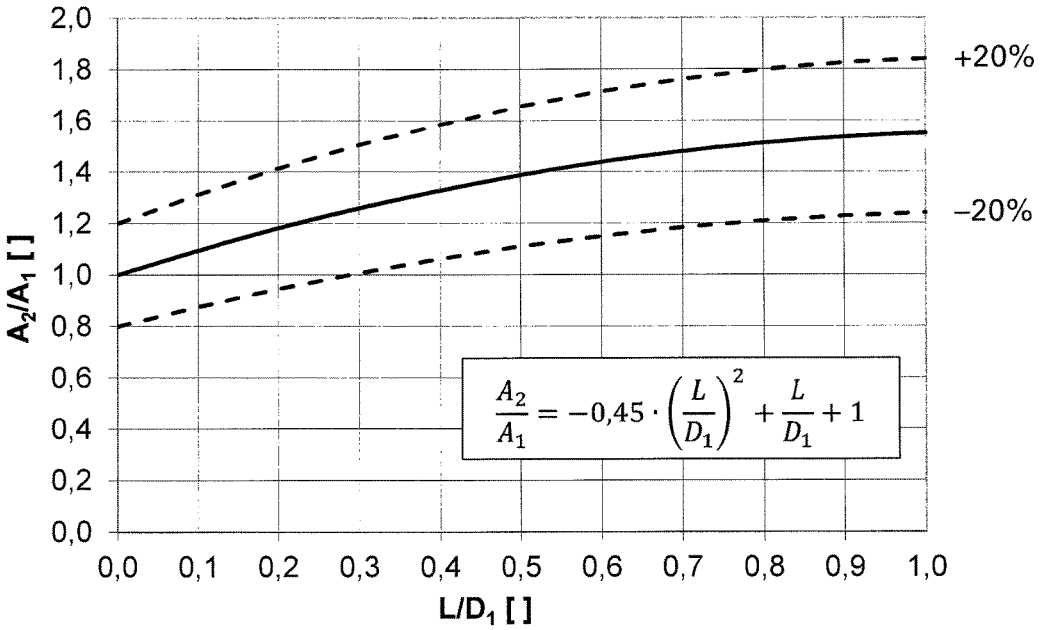
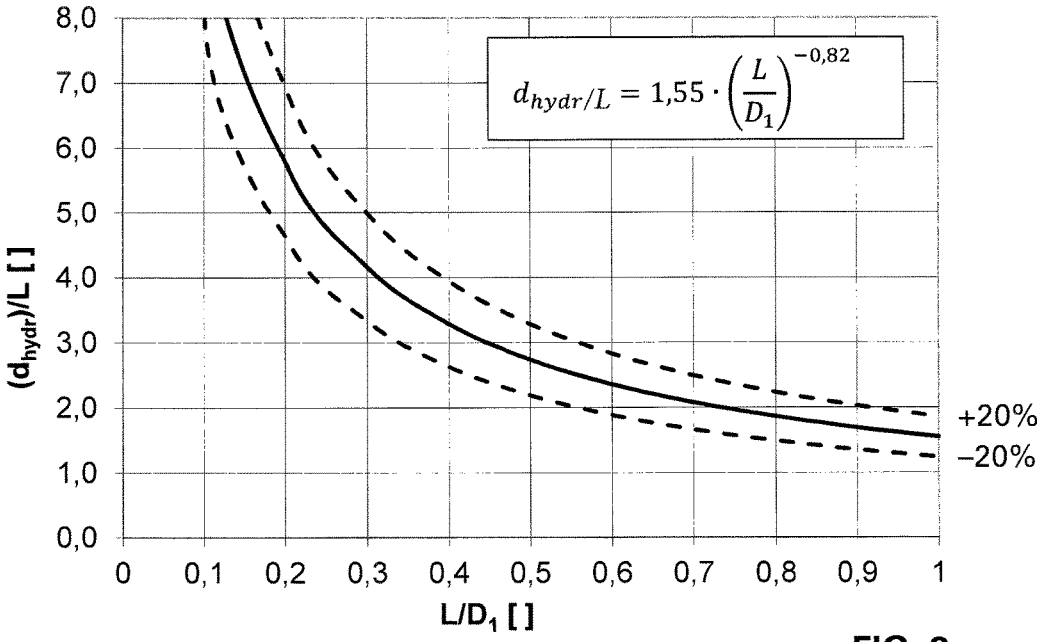
FIG. 8

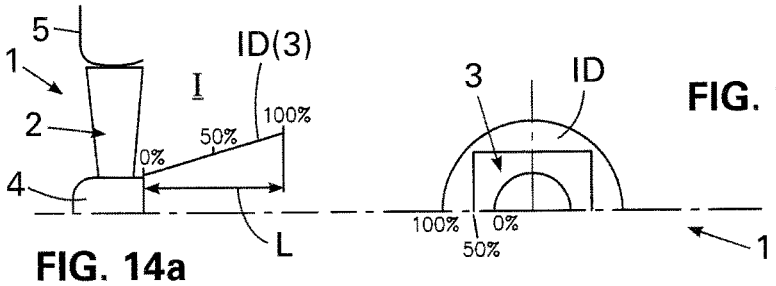
FIG. 14a
FIG. 14b
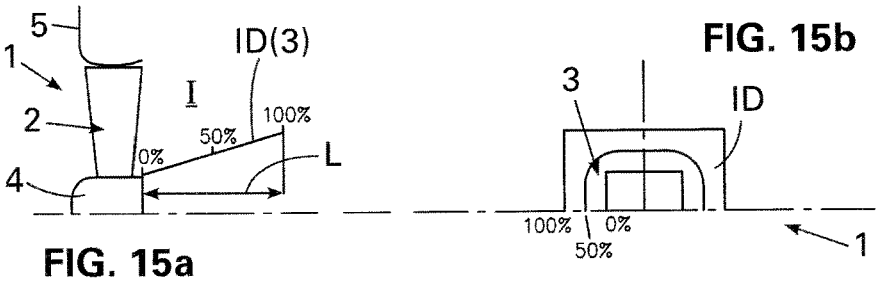
FIG. 15a
FIG. 15b
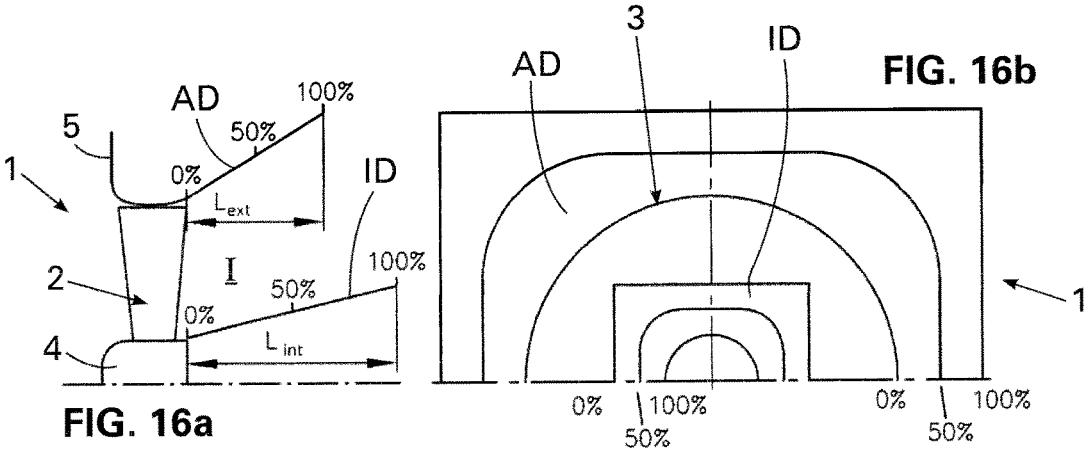
FIG. 16a
FIG. 16b
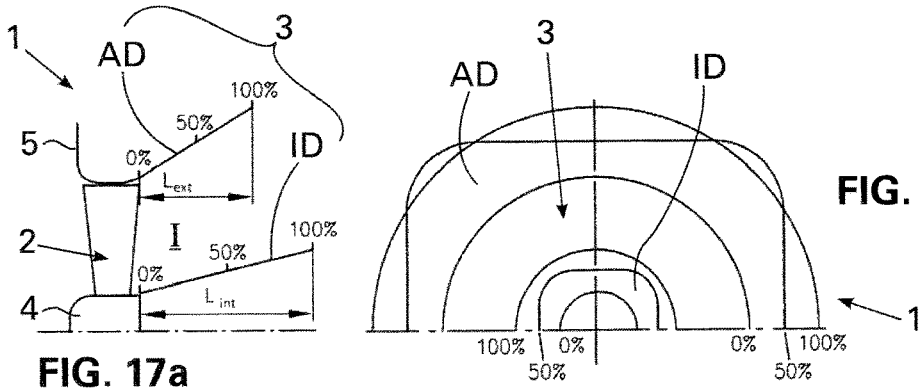
FIG. 17a
FIG. 17b

FAN DIFFUSER HAVING A CIRCULAR INLET AND A ROTATIONALLY ASYMMETRICAL OUTLET

CROSS-REFERENCE TO RELATED APPLICATION

The present application is the National Phase of International Patent Application PCT/EP2011/073090, filed on Dec. 16, 2011, and claims the priority of German patent application DE 20 2010 016 820.1, filed on Dec. 21, 2010, the entire disclosure of which is included herein by reference.

TECHNICAL FIELD

The invention relates to a diffuser for a fan of axial, radial or diagonal type of construction, having an inlet opening and having an outlet opening for a gaseous medium which flows through a diffuser interior, which is enclosed by an outer housing, in an axially oriented main flow direction from the inlet opening to the outlet opening, wherein the cross section of the outlet opening is larger than the cross section of the inlet opening, and the cross section of the diffuser interior increases from the cross section of the inlet opening to the cross section of the outlet opening, wherein the outer housing forms an outer diffuser part which delimits the diffuser interior to the outside. The invention also relates to an outer diffuser part or an inner diffuser part for a diffuser and to a fan arrangement which comprises a fan and a diffuser of said type.

BACKGROUND

The principle of a diffuser and also the use thereof downstream of a turbomachine have been known for decades. Diffusers are utilized in technical terms to convert kinetic energy into pressure energy. For this purpose, the flow must be decelerated. This is generally achieved by means of a continuous or discontinuous increase in size of the flow cross section, which may be realized geometrically in a variety of ways. In fan engineering, diffusers may be used to slow gas flows and increase the gas pressure. Here, in principle, a diffuser constitutes the inverse of a nozzle in that, by contrast to the nozzle, the cross section of the outlet opening is larger than the cross section of the inlet opening, and the cross section of the diffuser interior increases from the cross section of the inlet opening to the cross section of the outlet opening. This applies to gas flows at ultrasonic speeds.

The advantageousness of the use of a diffuser downstream of an axial, diagonal or radial fan is based on the fact that, in general, in all fan construction types, the losses that arise as a result of dissipation of the emerging volume flow are dominant in relation to other loss sources. A part of the flow energy of the emerging jet can, by means of the diffuser, be converted back into static pressure, wherein the increase of the static pressure effects an increase in efficiency. Furthermore, the rotational speed can be reduced for the same air throughput, which entails a reduction in noise.

A diffuser of the type mentioned in the introduction is known for example from EP 0 581 978 A1, which relates to a multi-zone diffuser for an axial-throughflow turbomachine, in which bend angles of the diffuser inlet—both at a hub and also at a cylinder of the turbomachine—are defined, exclusively for the purpose of homogenization of a total pressure profile, by means of the duct height at the outlet of the final blade row. Here, within a deceleration zone of the diffuser, means for eliminating the swirl of the swirling flow are provided in the form of flow ribs, and flow-guiding guide rings divide the diffuser into multiple ducts. In order, with a predefined diffuser area ratio, which is to be understood to mean the ratio of the flow cross sections at the outlet relative to the inlet of the diffuser, and with as small a diameter of the first diffusion zone as possible and with as great a pressure recovery as physically possible and with a swirl-free outflow, to keep the overall length of the diffuser at a minimum, different special embodiments of the first and second diffusion zones are provided for the diffuser, but these require a relatively high outlay in terms of manufacture.

In the case of the embodiment described in EP 0 581 978 A1 as being preferable, the known diffuser is situated in an exhaust-gas housing of a gas turbine, which exhaust-gas housing is designed such that it does not come into contact with the exhaust-gas flow. The actual flow guidance is performed by the diffuser which, in its first zone, is designed as an insert part for the exhaust-gas housing. For this purpose, an outer delimiting wall and an inner delimiting wall of the diffuser are held by means of flow ribs. The outer delimiting wall, which delimits the cross section of the diffuser interior to the outside, forms an outer housing of the diffuser, and the inner delimiting wall, which delimits the cross section of the diffuser interior to the inside, forms an inner housing. The diffuser can thus be considered as being composed of an outer diffuser part, which delimits the flow space to the outside, and an inner diffuser part, which delimits the flow space to the inside.

It is the object of the invention to design a diffuser, an outer diffuser part and/or an inner diffuser part for a diffuser and a fan arrangement of known type such that improvements in the operating behavior of an axial, diagonal or radial fan with regard to efficiency and noise can be attained with little outlay in terms of construction.

Said object is achieved according to the invention in that, along the main flow direction, the cross section of the outer diffuser part changes from a circular cross section at the inlet opening to a non-circular cross section at the outlet opening. Alternatively, in the case of a generic diffuser in which, in addition, an inner diffuser part is arranged concentrically with respect to the outer diffuser part in a known way, and which has a housing which, as an inner housing, delimits the diffuser interior to the inside, the object on which the invention is based is achieved in that the inner diffuser part has, in at least one section perpendicular to the main flow direction, a non-circular cross section about the axis of rotation of the fan.

In a way which is essential to the invention, therefore, there may on the one hand be provided an outer diffuser part for a fan of axial, radial or diagonal type of construction, which outer diffuser part changes, substantially along the main flow direction, from a circular to a non-circular cross section, wherein an inner diffuser part of arbitrary design is provided. On the other hand, there may also be provided in the diffuser an inner diffuser part which, in at least one section, has a non-circular cross section about the axis of rotation of the fan, wherein an outer diffuser part of arbitrary design is provided. The non-circular cross section may be in particular one which is of polygonal, in particular square, basic shape. Here, the invention encompasses the corresponding design of the outer diffuser part and/or of the inner diffuser part.

As in the case of known diffusers positioned downstream of a fan, a diffuser according to the invention effects a pressure conversion from dynamic pressure into static pressure. Here, the speed of the fluid is reduced and homogenized. Whereas a known diffuser designed so as to be fully rotationally symmetrical with respect to the axis of rotation of the fan converts the speed predominantly in an axial direction—that is to say the axial component of the speed vector—into static pressure, and with assumed swirl constancy reduces the circumferential component of the speed only to the extent by which the diameter increases, a diffuser according to the invention additionally converts a part of the circumferential speed of the gas into static pressure, because the non-rotationally symmetrical geometry impedes a movement in a circumferential direction. As a result, the diffuser efficiency advantageously increases.

The diffuser according to the invention, which has a not completely rotationally symmetrical flow cross section as a result of the design of its outer diffuser part and/or inner diffuser part, also offers a further advantage. The maximum installation space available for a diffuser is, in terminal equipment, normally prismatic, and a maximum width, a maximum height and a maximum length are defined by the product. Under these conditions, as a result of the corners present for example in the case of a polygonal, in particular square, cross section, it is possible with a diffuser according to the invention to utilize a larger surface area normal to the axis of rotation of the fan, and thus permit a greater reconversion of the axial speed, by comparison with a completely rotationally symmetrical diffuser. This, too, increases the diffuser efficiency.

Also, in the case of a diffuser according to the invention, owing to the possible utilization of the corners, and without the defined installation space boundaries being crossed, the cross section of the outlet opening has an equivalent radius greater than that of a completely rotationally symmetrical diffuser and can thus achieve an increased pressure reconversion from the circumferential speed. Here, an equivalent radius is to be understood to mean the radius of a circle which has the same surface area as the non-circular diffuser surface. Twice the equivalent radius is also referred to as the hydraulic diameter.

A diffuser according to the invention may advantageously be used together with an axial, radial or diagonal fan operated in particular by means of an electric external-rotor motor, without a follow-up guide wheel having to be provided here.

Here, the overall construction of a fan arrangement with a fan and with a diffuser according to the invention may be of single-part or two-part form. A single-part construction is to be understood here to mean that a static component of the fan, in particular a wall ring, and the entire diffuser—that is to say the inner and/or the outer diffuser part—are formed as a single component. In this way, the wall ring of the fan becomes a constituent part of the diffuser.

A two-part construction is to be understood to mean that the diffuser according to the invention is formed as a component which is separate from the static components of the fan—that is to say as a separate component—wherein said diffuser however can be or is fastened to the static parts of the fan, in particular to the wall ring or to a protective grille, by fastening means such as screws, rivets, clamps etc., or by means of non-positively locking, positively locking and/or cohesive connections, such as by means of a bayonet lock, by means of a clip connection, by means of a welded connection or the like. Here, it is advantageously also possible for a diffuser according to the invention to be designed so as to be suitable for retroactive mounting on an already-installed fan.

Furthermore, in the case of such a two-part construction of an arrangement, it is also possible for the fan itself to be of multi-part construction, which is to be understood to mean that it may also be composed of multiple individual diffuser parts which can be or are connected to one another via fastening means or connections as mentioned above. Here, the diffuser parts which can be assembled in this way at the location of use may be designed in a logistically advantageous manner, such that they can for example be stacked, thus reducing the transport volume. In this way, it is possible for the diffuser geometry, in particular the diffuser length, to be varied according to the requirements through the omission or exchange of individual diffuser parts.

Further advantageous embodiments of the invention will emerge from the following description. The invention will be explained in more detail on the basis of a plurality of exemplary embodiments illustrated in the appended Figures of the drawing:

BRIEF DESCRIPTION OF THE DRAWINGS

FIG. 7 shows a graphic illustration of a preferred dependency of a ratio of the cross-sectional area of the diffuser on the gas outlet side to the cross-sectional area of the diffuser on the gas inlet side on a ratio of the length of the diffuser to an outer diameter of the inlet opening of the diffuser, FIG. 8 shows a graphic illustration of a preferred dependency of a ratio of the hydraulic diameter to the length of the diffuser on a ratio of the length of the diffuser to an outer diameter of the inlet opening of the diffuser.

DETAILED DESCRIPTION OF THE DRAWINGS

Figure 1:
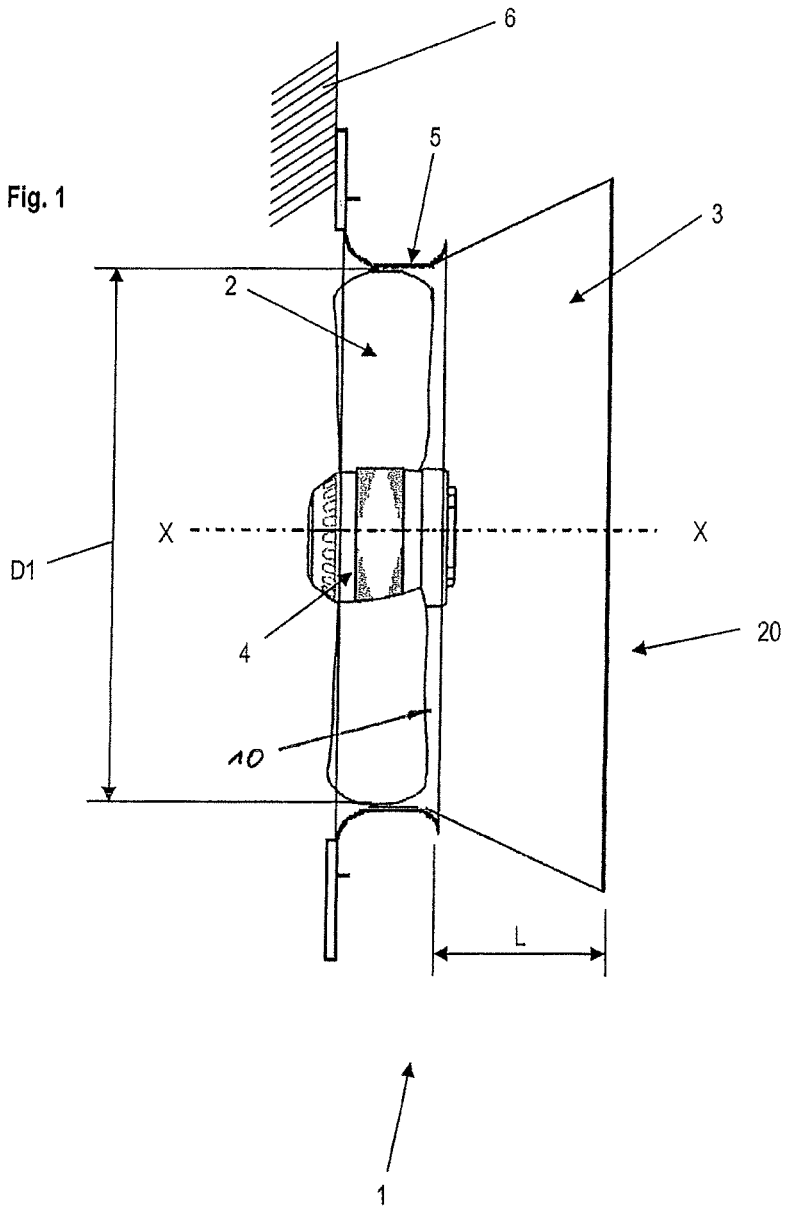
FIG. 1 shows, in a longitudinal section, a diagrammatic illustration of a fan arrangement composed of a fan and a diffuser, in which fan arrangement a diffuser according to the invention is or can be used.

With regard to the following description, it is expressly stated that the invention is not restricted to the exemplary embodiments, and is also not restricted to all or several features of described combinations of features; rather, each individual property of the exemplary embodiment may also have independent inventive significance separately from all of the other property described in connection therewith.

In the Figures of the drawing, the same parts are also always denoted by the same reference characters, such that each of the parts may generally also be described only once.

Figure 2:
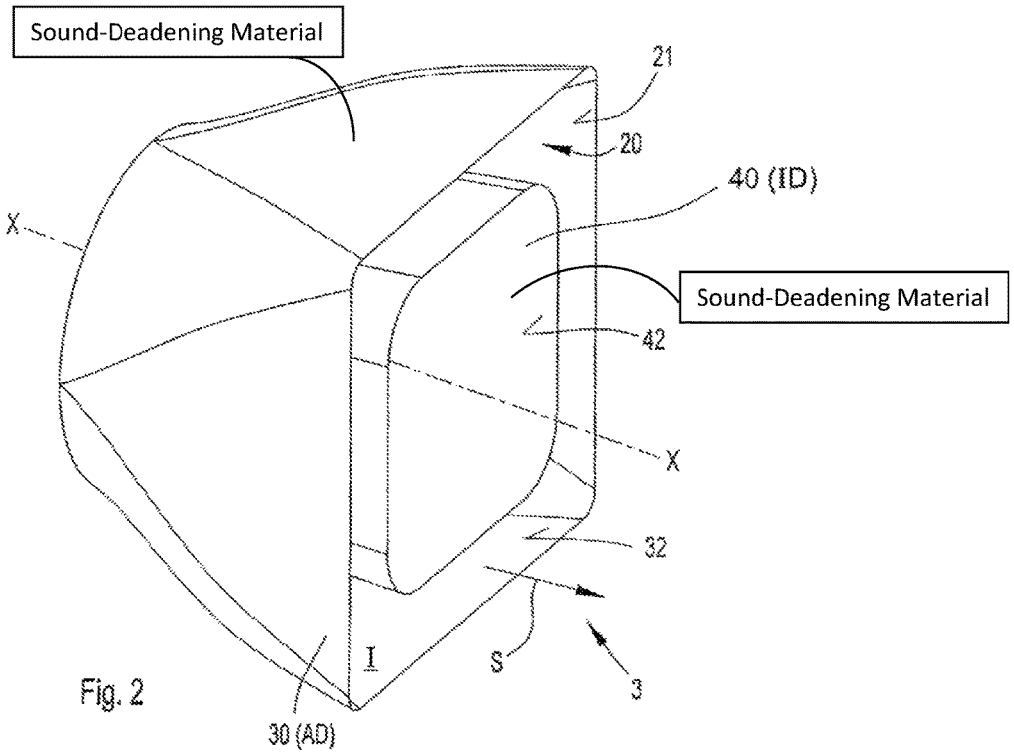
FIG. 2 shows a perspective view of a gas outlet side of a preferred embodiment of a diffuser according to the invention.
Figure 3:
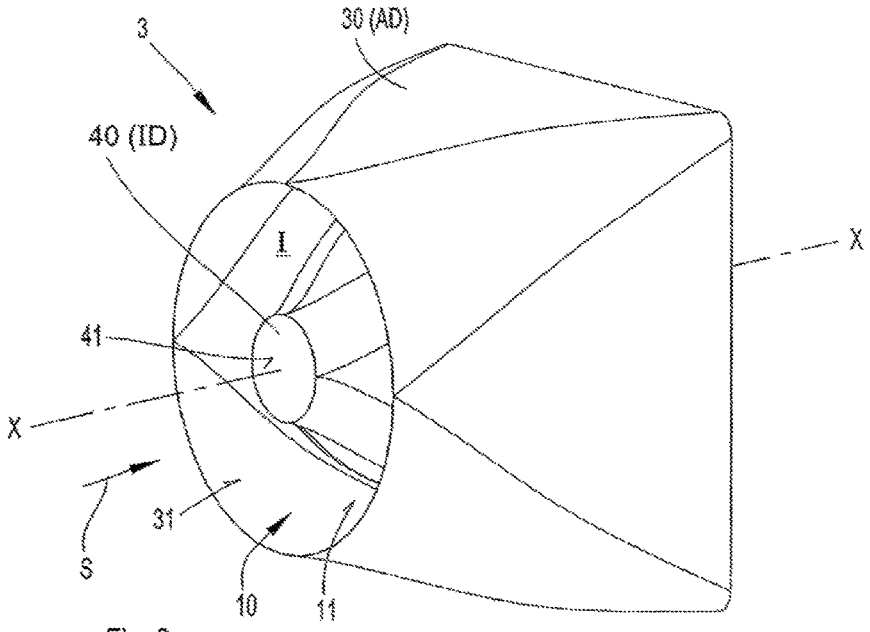
FIG. 3 shows a perspective view of a gas inlet side of the preferred embodiment of a diffuser according to the invention illustrated in FIG. 2.
Figure 4:
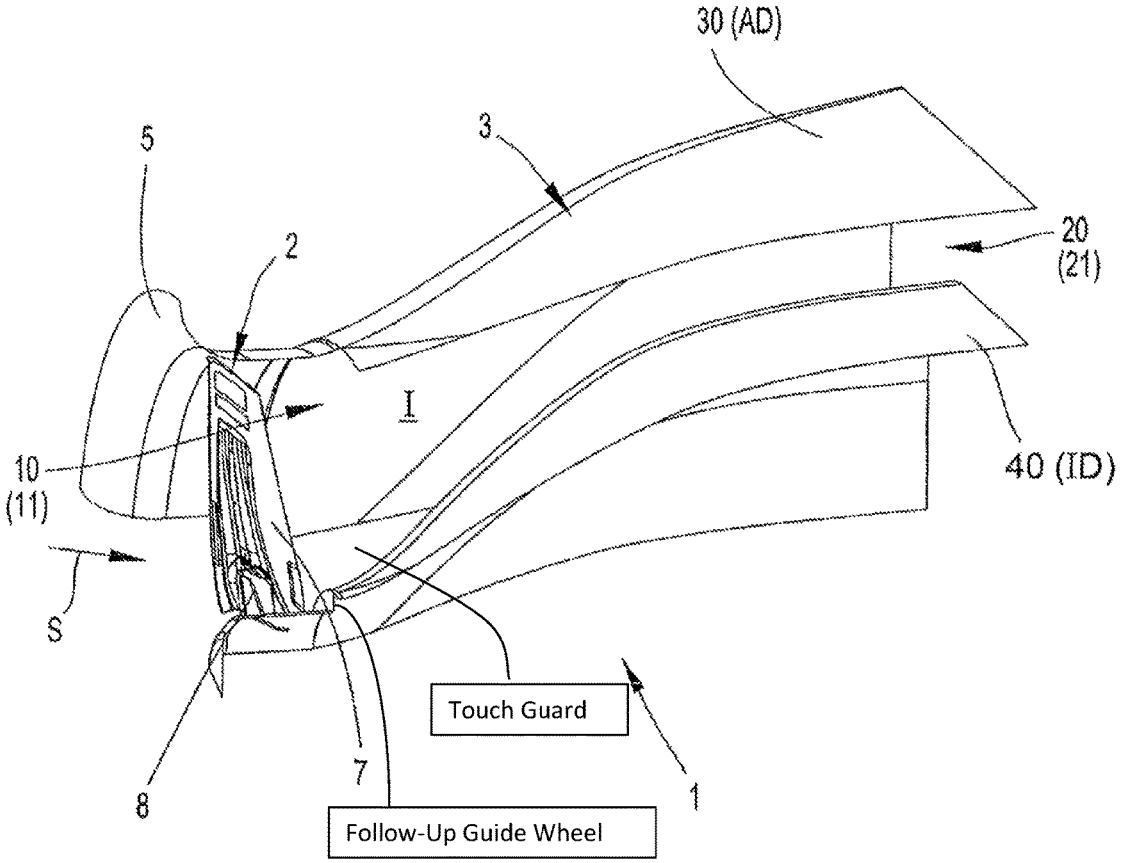
FIG. 4 shows a fan arrangement according to the invention in a perspective sectional view.

As can be seen initially from the illustration of FIG. 1, a fan arrangement 1 according to the invention comprises a fan 2, for example of axial type of construction as illustrated, and a diffuser 3 which—though not readily apparent from the schematic illustration—is or at least may be designed according to the invention, as shown in an exemplary manner in FIGS. 2 and 3 for a diffuser 3 according to the invention and as shown in more detail in FIG. 4 for the arrangement 1 according to the invention. The fan 2, which may alternatively also be a fan of radial or diagonal type of construction, is operated by means of a motor 4 and is fastened via a wall ring 5 to a support base 6, such as a wall.

Figure 5:
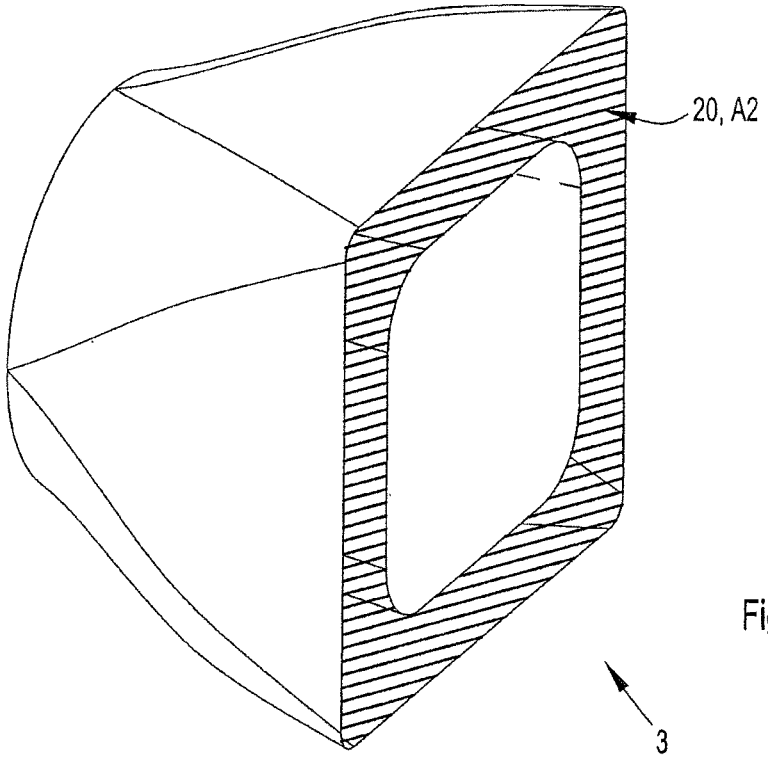
FIG. 5 shows a perspective view similar to FIG. 2.
Figure 6:
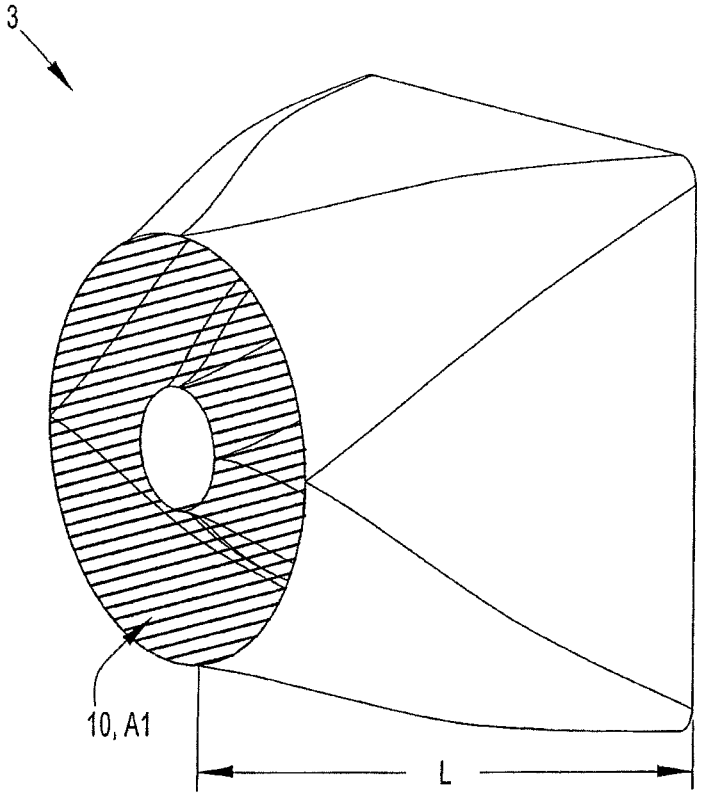
FIG. 6 shows a perspective view similar to FIG. 3.

FIGS. 2 and 3 and also FIGS. 5 and 6 show that a diffuser 3 according to the invention has an inlet opening 10 and an outlet opening 24 for a gaseous medium which flows through a diffuser interior I, which is enclosed by an outer housing 30, in an axially oriented main flow direction S—that is to say a main flow direction which runs substantially parallel to the longitudinal axis X-X of the diffuser 3—from the inlet opening 10 to the outlet opening 20. The inlet opening 10 illustrated in FIG. 1 has a circular outer contour, wherein reference sign D1 denotes the diameter of the fan 2. The diffuser 3 has a length L.

The cross section 21 (hatched cross-sectional area A2 in FIG. 5) of the outlet opening 20 is larger than the cross section 11 (hatched cross-sectional area A1 in FIG. 6) of the inlet opening 10, and the cross section of the diffuser interior I increases, in particular continuously, from the cross section 11 of the inlet opening 10 to the cross section 21 of the outlet opening 20. The outer housing 30 forms an outer diffuser part AD which delimits the diffuser interior I to the outside.

It is provided according to the invention that, along the main flow direction S, the cross section of the outer diffuser part AD changes from a circular cross section 31 at the inlet opening 10 to a non-circular cross section 32 at the outlet opening 20. The latter is preferably substantially square, as illustrated in FIG. 2.

Concentrically with respect to the outer diffuser part AD, there is arranged an inner diffuser part ID which, by means of the inner housing 40 which forms it, delimits the diffuser interior I to the inside. It is provided here according to the invention that the inner diffuser part ID has, in at least one section perpendicular to the main flow direction S, a non-circular cross section 42 about the common longitudinal axis X-X of the inner diffuser part ID and outer diffuser part AD. Here, such a cross section 42 which is non-circular aside from roundings in the corners to avoid stalling and which is substantially square, that is to say is square in terms of basic shape, is provided for example at the outlet opening 20. The cross section 41 of the inner diffuser part ID at the inlet opening 10 is, by contrast, of circular form.

In the case of a diffuser 3 with an inner diffuser part ID arranged concentrically with respect to the outer diffuser part AD, which inner and outer diffuser parts have approximately the same length L (less than 10 percent difference in relation to the length of the larger part), a design of the surface profile according to formula (1) can be regarded as a particularly advantageous embodiment:

$$A2/A1=-0.45*(L/D1)^2+L/D1+1 \quad (1),$$

wherein the value A2/A1 may vary by ±20 percent. The formula (1) is illustrated by FIG. 7, wherein—as also already stated above—A1 is the area through which flow passes at the diffuser inlet 10, A2 is the area through which flow passes at the diffuser outlet 20, L is the diffuser length and D1 is the fan diameter.

It has been found that a hydraulic diameter $d_{hydr}$ (double the value of the equivalent radius) related to length can—in particular independently of an inner diffuser part ID—be regarded as optimal if it is dimensioned in accordance with formula (2):

$$d_{hydr}/L=1.55*(L/D1)^{-0.82} \quad (2),$$

as illustrated by FIG. 8. Here, too, the admissible range of variation is ±20 percent of the calculated value $d_{hydr}/L$.

Diffuser walls which form the inner housing 40, the outer housing 30 and/or—in the case of a multi-part construction—parts thereof may be composed of plastic and produced preferably by primary forming or shaping processes such as injection molding, extrusion, rotary molding, foaming, vacuum deep-drawing, blow molding or the like.

Here, in a hybrid-type design, mechanically highly loaded regions of the diffuser 3 can be reinforced by at least one metal part inlaid during the primary forming process or subsequently attached.

Also, in a frame-type design, a load-bearing structure of the diffuser 3 may be a framework spanned by a thin material composed in particular of plastic or sheet metal.

In one advantageous embodiment of a multi-part diffuser 3, it is possible for thin (thickness of less than 1 mm, preferably less than 0.5 mm), originally planar plates, in particular punched metal sheets, to be bent and connected to one another during assembly. Additional add-on parts may be used for stiffening this construction.

Figure 9:
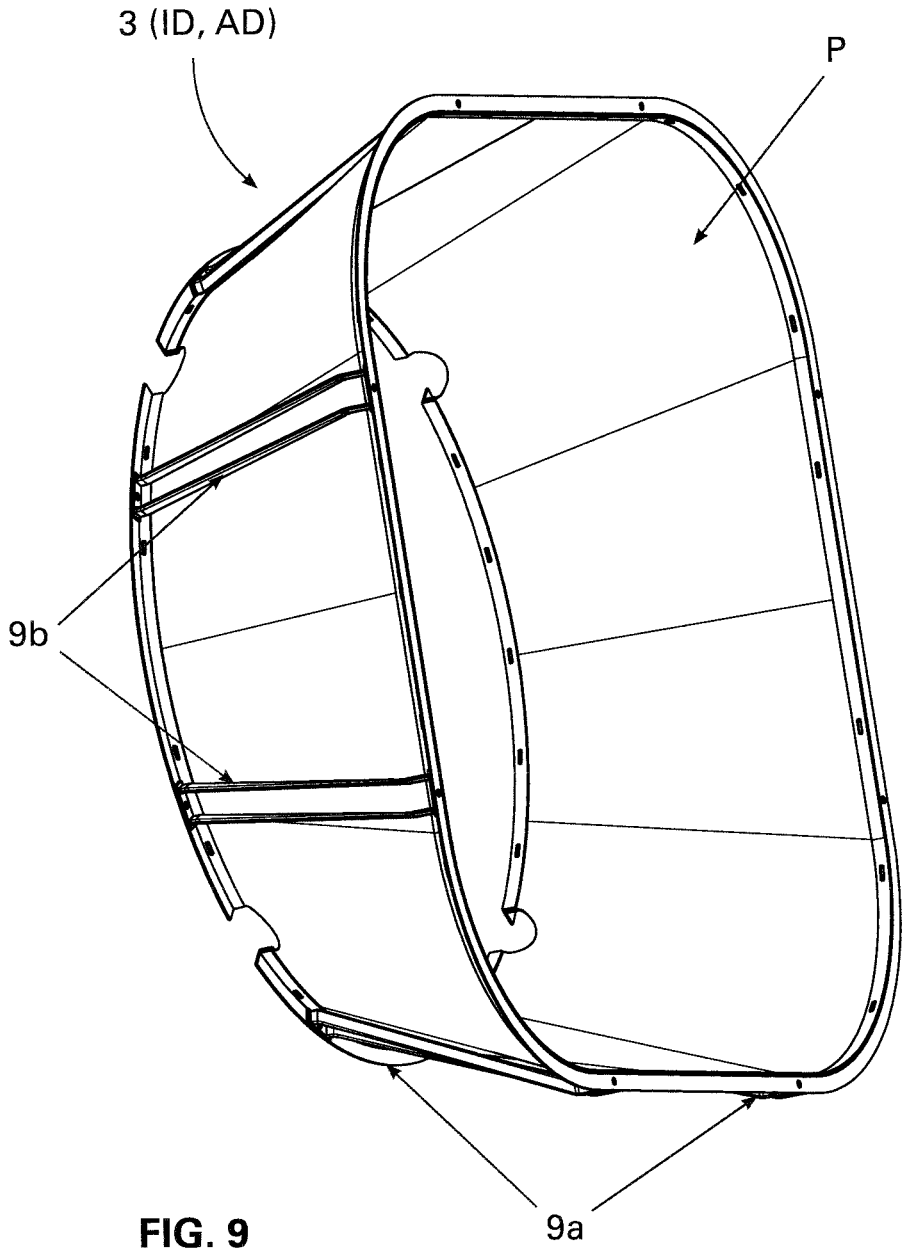
FIG. 9 shows a perspective view of a preferred embodiment of an outer or inner diffuser part according to the invention, FIGS. 10*a*, 10*b*, 11*a*, and 11*b* each show an axial and a radial half-section of two preferred embodiments of an outer diffuser part according to the invention in a fan arrangement according to the invention, FIGS. 12*a* and 12*b* through FIGS. 15*a* and 15*b* each show an axial and a radial half-section of four preferred embodiments of an inner diffuser part according to the invention in a fan arrangement according to the invention, FIGS. 16*a*, 16*b*, 17*a*, and 17*b* each show an axial and a radial half-section of two preferred embodiments of combinations of outer and inner diffuser parts according to the invention in a fan arrangement according to the invention, wherein the outer diffuser part is shortened, FIGS. 18*a*, 18*b*, 19*a*, and 19*b* each show an axial and a radial half-section of two preferred embodiments of combinations of outer and inner diffuser parts according to the invention in a fan arrangement according to the invention, FIGS. 20*a*, 20*b*, 21*a*, and 21*b* each show an axial and a radial half-section of two preferred embodiments of combinations of outer and inner diffuser parts according to the invention in a fan arrangement according to the invention, wherein the inner diffuser parts are shortened.

FIG. 9 shows an embodiment of a diffuser 3 according to the invention which may also be used as an outer diffuser part AD or as an inner diffuser part ID or as an outer housing 30 or as an inner housing 40. Said design is suitable in particular as a construction solution for wall rings 5 with a diameter D1 of greater than 500 mm. The wall of this design is manufactured from a foil or flexible cover P composed preferably of plastic, which foil or flexible cover can advantageously be folded for transport. The logistical outlay can thus be reduced. To produce the diffuser 3 or diffuser part AD, ID, it is for example possible for a pre-cut flexible cover part to be welded together and connected to load-bearing and shaped rings 9*a* which surround the inlet opening 10 and the outlet opening 20. Here, the load-bearing and shaped rings 9*a* may be connected to one another via supporting struts 9*b*, wherein said load-bearing and shaped rings together with said supporting struts form in particular, in a frame-type design, a framework as stated above. In the illustrated case, the load-bearing and shaped ring 9*a* at the inlet opening 10 is circular, and the load-bearing and shaped ring 9*a* at the outlet opening 20 is approximately square but with rounded corners. Here, not only can the flexible cover P be supported by the load-bearing and shaped rings 9*a*, but rather the rings 9*a* may advantageously also serve for receiving a protective grille, in particular at the outlet opening 20, in order to screw a wall ring 5 to the inlet opening 10. By means of the supporting struts 9*b*, which—like the load-bearing and shaped rings 9*a*—may be produced from steel or plastic depending on the required strength, it is possible, if appropriate using an additional tensing device, for the flexible cover P to be tensed. Since the flexible cover P is a flexible component, it is possible for the length L of the diffuser 3 to be changed with little outlay by means of a changed pre-cut form of the flexible cover P (and a modification of the supporting struts 9*b*). It is also possible in a simple manner for the flexible cover P to be provided with a surface geometry (so-called riblets) which yields a reduction in friction resistant on surfaces over which turbulent flow passes. For this purpose, microscopically small channels with a spacing to one another of less than 100 μm may be formed into the flexible cover, which channels prevent transverse movements of the flow and thereby reduce the wall friction by up to approximately 8 percent.

The diffuser 3 according to the invention may also be formed with a touch guard which is formed either in one piece with the inner housing 40 and/or the outer housing 30 or is formed as a separate component. If the diffuser 3 is formed with a touch guard, it is possible for a fan touch guard grille such as is conventionally used with fans to be omitted or made structurally significantly simpler. Since, according to the invention, the touch guard is generally at a greater distance from the rotor—the illustration in FIG. 4 shows a fan blade 7 (with hub 8)—than a conventionally used touch guard grille, the strut spacing can be designed to be larger, which may be advantageous in terms of flow and in terms of acoustics. Here, the touch guard may be of structurally very simple design, for example in the form of rectangular struts.

Even though a preferred use according to the invention consists in the use of a diffuser 3 designed according to the invention for a low-pressure axial fan or low-pressure diagonal fan, operated in particular with an electric external-rotor motor, without follow-up guide wheel, a diffuser 3 according to the invention may nevertheless be formed with a follow-up guide wheel. Such a follow-up guide wheel is composed of static guide elements and diverts circumferential and/or radial components of the flow speed in the diffuser 3 in the axial direction X-X. In this way, the follow-up guide wheel increases the static pressure reconversion of the diffuser 3. Similarly to the situation described for a touch guard, the follow-up guide wheel may be formed in one piece—follow-up guide wheel and diffuser form a structural unit—or may be formed as a separate component.

The diffuser 3 may also be designed such that, in addition to its inherent function, it simultaneously realizes both the follow-up guide wheel function and also the touch guard function. Here, too, a design in one piece with the outer/inner diffuser part 30/40 or a design as a separate part that can be mounted on the diffuser 3 is possible.

The diffuser 3 may be equipped with a sound-deadening means, in particular by means of sound-deadening materials. For this purpose, it is for example possible for a deadening material to be applied to the inner side, which faces toward the main flow S, of the diffuser 3 in the diffuser interior I in such a way that the free surface of the sound-deadening material forms the diffuser wall, which is active in terms of flow, of the inner housing 40 and/or of the outer housing 30. However, the sound-deadening material may be additionally or exclusively applied to the diffuser outer surface which faces away from the main flow S—that is to say on the outside of the outer diffuser part 30. To reduce mid- to low-frequency sound radiation, the diffuser may be equipped with a system for active noise reduction—"active noise control".

FIGS. 10*a* and 10*b* through FIGS. 23*a* and 23*b* illustrate, in axial and radial half-sections, preferred embodiments of outer diffuser parts AD according to the invention and/or inner diffuser parts ID according to the invention and combinations thereof in fan arrangements 1 according to the invention. Here, apart from in FIGS. 22*a* and 22*b*, the contours of the diffuser parts AD, ID in the radial half-section are illustrated for three selected positions (0 percent of the length L, 50 percent of the length L and 100 percent of the length L).

Figure 20A:
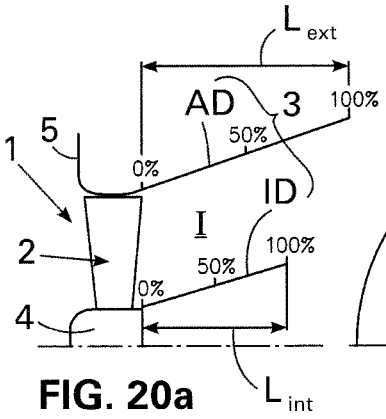
Figure 21A:
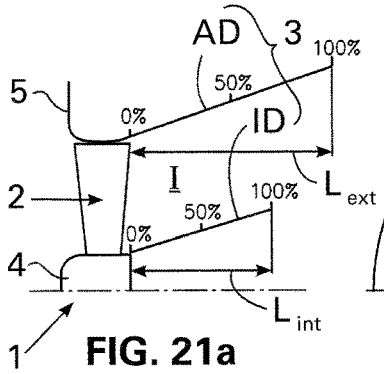
Figure 22A:
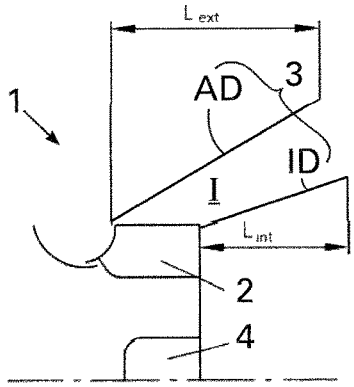
FIG. 22*a* shows an axial half-section of a fan arrangement according to the invention with a centrifugal fan.

As shown by the various embodiments, it is possible with regard to the lengths of the diffuser parts AD, ID to make a distinction between three different variants:

A) both parts AD, ID have the same length L (FIG. 18*a*, FIG. 19*a*, FIG. 22*b*) or there is only one part AD, ID with a certain length L (FIG. 10*a* to FIG. 15*a*, FIG. 23*a*);

B) the length (denoted in this case by the reference sign $L_{ext}$) of the outer diffuser part AD is smaller than the length (denoted in this case by the reference sign $L_{int}$) of the inner diffuser part ID (FIG. 16*a*, FIG. 17*a*);

C) the length (likewise denoted in this case by the reference sign $L_{ext}$) of the outer diffuser part AD is greater than the length (likewise denoted in this case by the reference sign $L_{int}$) of the inner diffuser part ID (FIG. 20*a*, FIG. 21*a*, FIG. 22*a*).

Figure 22B:
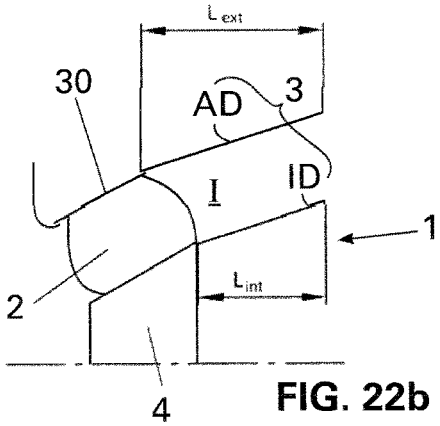
FIG. 22*b* shows an axial half-section of a fan arrangement according to the invention with a diagonal fan, FIGS. 23*a* and 23*b* each show an axial and a radial half-section of a fan arrangement according to the invention as in FIGS. 12*a*, 12*b*, having an inner diffuser part, wherein the outlet surface is highlighted.

As shown in FIG. 22*a*, variant B) can be used preferably in a centrifugal fan, and as shown in FIG. 22*b*, variant A) can preferably be used in a diagonal fan.

Figure 10A:
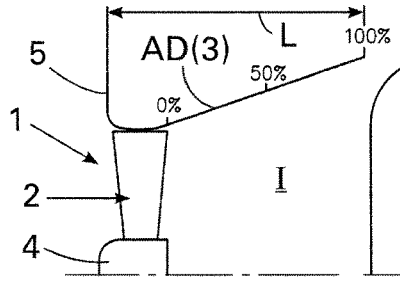
Figure 10B:
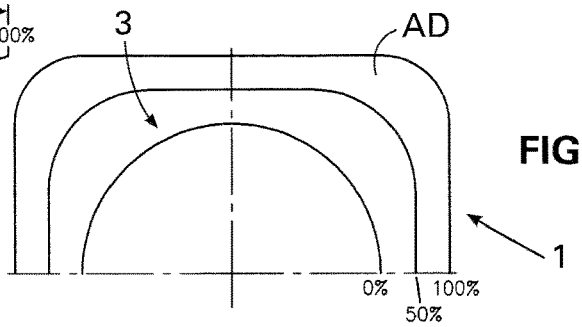
Figure 12A:
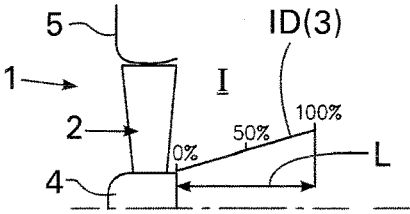
Figure 12B:
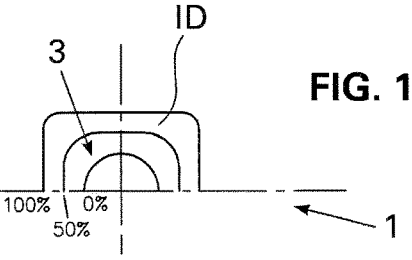

FIG. 10*a*/FIG. 10*b* illustrate an outer diffuser part AD with the following design of its contour: at 0 percent of the length L—circular (rotationally symmetrical); at 50 percent of the length L—substantially square (that is to say with rounded corners, not rotationally symmetrical); at 100 percent—likewise substantially square (that is to say with corners which are rounded but more pronounced than at 50 percent, not rotationally symmetrical). FIG. 12*a*/FIG. 12*b* illustrate a similarly designed inner diffuser part ID.

Figure 11A:
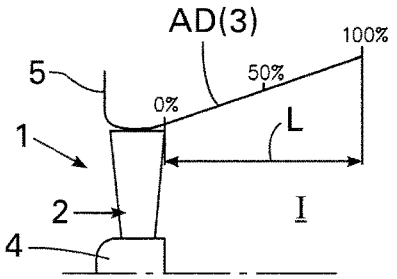
Figure 11B:
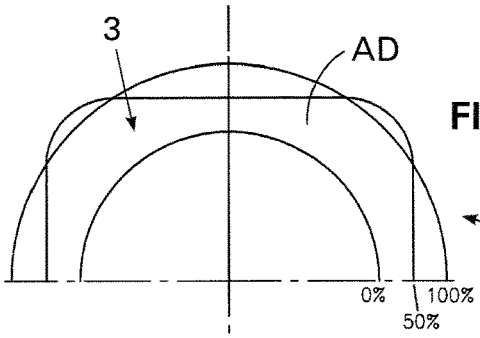

FIGS. 11*a* and 11*b* illustrate an outer diffuser part AD with the following design of its contour: at 0 percent of the length L—circular (rotationally symmetrical); at 50 percent of the length L—substantially square (that is to say with rounded corners, not rotationally symmetrical); at 100 percent—circular (rotationally symmetrical). FIG. 14*a*/FIG. 14*b* illustrate a similarly designed inner diffuser part ID.

Figure 13A:
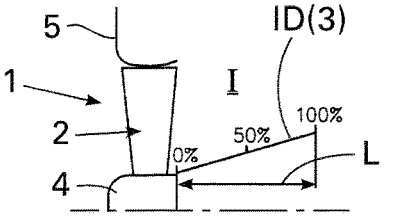
Figure 13B:
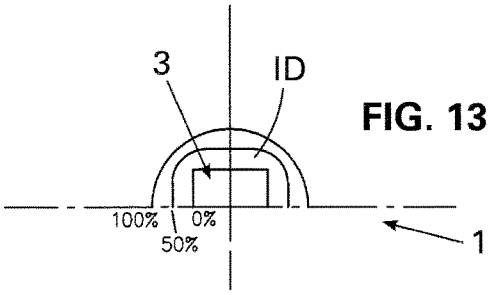

FIGS. 13*a* and 13*b* illustrate an inner diffuser part ID with the following design of its contour: at 0 percent of the length L—square (not rotationally symmetrical); at 50 percent of the length L—substantially square (that is to say with rounded corners, not rotationally symmetrical); at 100 percent—circular (rotationally symmetrical).

FIGS. 15*a* and 15*b* illustrate an inner diffuser part ID with the following design of its contour: at 0 percent of the length L—square (not rotationally symmetrical); at 50 percent of the length L—substantially square (that is to say with rounded corners, not rotationally symmetrical); at 100 percent—square (not rotationally symmetrical).

FIGS. 16*a* and 16*b* illustrate a fan arrangement 1 according to the invention in which is provided an outer diffuser part AD with a design according to FIG. 10*a*/FIG. 10*b*, but without rounded corners at 100 percent of the length $L_{ext}$, which outer diffuser part is combined with an inner diffuser part ID with a design according to FIG. 15*a*/FIG. 15*b*. The length $L_{ext}$ of the outer diffuser part AD is smaller than the length $L_{int}$ of the inner diffuser part ID.

FIGS. 17*a* and 17*b* illustrate a fan arrangement 1 according to the invention in which is provided an outer diffuser part AD with a design according to FIG. 11*a*/FIG. 11 *b*, which outer diffuser part is combined with an inner diffuser part ID with a design according to FIG. 14*a*/FIG. 14*b*, but with rounded corners at 50 percent of the length $L_{int}$. Here, too, the length $L_{ext}$ of the outer diffuser part AD is smaller than the length $L_{int}$ of the inner diffuser part ID.

Figure 18A:
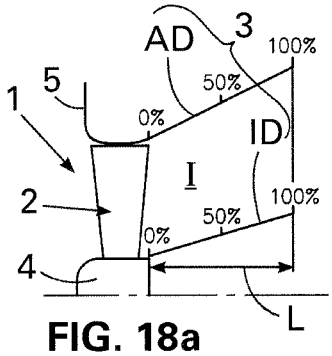
Figure 18B:
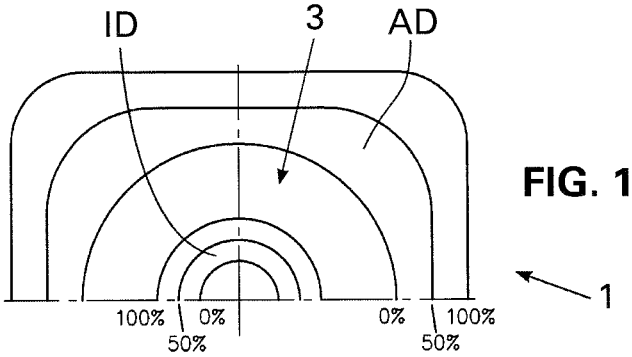

FIGS. 18*a* and 18*b* illustrate a fan arrangement 1 according to the invention in which is provided an outer diffuser part AD with a design according to FIG. 10*a*/FIG. 10*b*, which outer diffuser part is combined with an inner diffuser part ID in which a circular cross section is provided over the entire length L. The length L of the outer diffuser part AD is equal to the length L of the inner diffuser part ID.

Figure 19A:
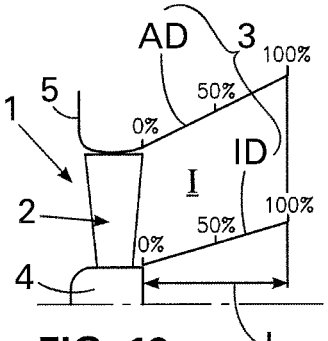
Figure 19B:
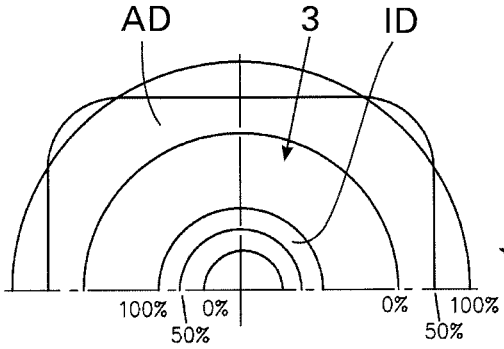

FIGS. 19*a* and 19*b* show a fan arrangement 1 according to the invention as in FIG. 18*a*/FIG. 18*b*, with the difference that the outer diffuser part AD has a design according to FIG. 11*a*/FIG. 11 *b*.

Figure 20B:
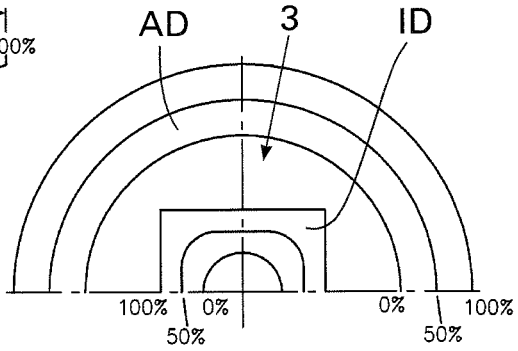

FIGS. 20*a* and 20*b* illustrate a fan arrangement 1 according to the invention in which is provided an inner diffuser part ID with a design according to FIG. 12*a*/FIG. 12*b*, but without rounded corners at 100 percent of the length $L_{int}$, which inner diffuser part is combined with an outer diffuser part AD in which a circular cross section is provided over the entire length L. The length $L_{ext}$ of the outer diffuser part AD is greater than the length $L_{int}$ of the inner diffuser part ID.

Figure 21B:
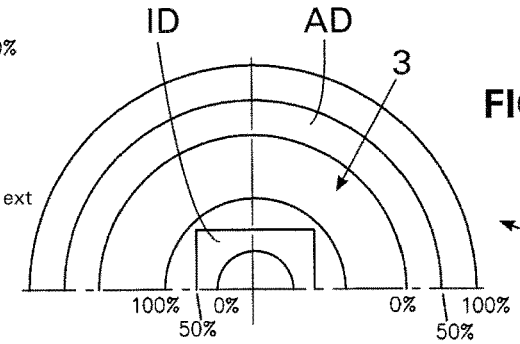

FIGS. 21*a* and 21*b* show a fan arrangement 1 according to the invention as in FIG. 10*a*/FIG. 10*b*, with the difference that the inner diffuser part ID has a design according to FIGS. 14*a* and 14*b*.

The various embodiments of the invention illustrated above each have specific advantages determined by the type of construction of the respective fan 2, in particular by the outflow field of the fan 2 and/or by the available installation space and by further boundary conditions. This is illustrated by way of example by FIG. 22*a* and FIG. 22*b*, which are already mentioned above.

Figure 23A:
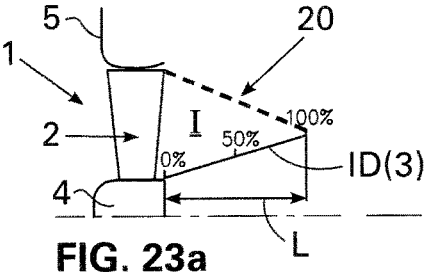
Figure 23B:
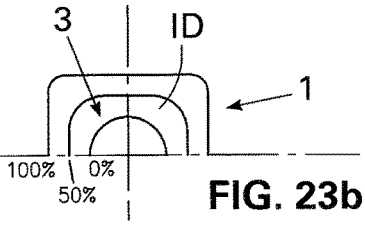

From the illustration, shown in FIGS. 23*a* and 23*b* of the embodiment according to FIGS. 12*a* and 12*b*, it is clear that not only an outer diffuser part AD alone (without inner diffuser part ID) but also an inner diffuser part ID alone (without outer diffuser part AD) may perform the function of a complete diffuser 3, as indicated in the drawing by the reference sign 3 placed in each case between parentheses. A space of the diffuser 3 which corresponds in the latter embodiments to the interior I of the other embodiments is therefore likewise denoted in said embodiments by the reference sign I. As shown in particular by FIG. 23*a*, said space is delimited at one side by the wall ring 5 and at the other side by the inner diffuser part ID, wherein the outlet opening 20 extends, or the outflow cross-sectional area A2 of the diffuser 3 is spanned, between said two parts 5, ID. It is thus not necessary for an outer housing 30 to be provided.

As emerges already from the above embodiments, the present invention is not restricted to the illustrated exemplary embodiments but rather encompasses all means and measures which are equivalent within the meaning of the invention. It thus also falls within the scope of the invention for the inlet opening 10 to not have a circular annular cross section 11 owing to a corresponding design of the outer diffuser part AD and/or of the inner diffuser part ID, and/or for the outlet opening 20 to not have an annular cross section 21 with a square outer and inner contour of the opening 20, which is however of annular basic shape in any case, owing to a corresponding design of the outer diffuser part AD and/or of the inner diffuser part ID.

The rotational asymmetry according to the invention in at least one cross-sectional region of the diffuser interior I may be realized on the one hand by means of a corresponding—in each case exclusive—design of the outer diffuser part AD or of the inner diffuser part ID or on the other hand by means of the design both of the outer housing 30 and also of the inner housing 40. Here, the cross section of the diffuser interior space I may vary in a variety of ways along the main flow direction S.

Here, aside from the embodiments illustrated in the drawings, as further embodiments which are not illustrated, the two following embodiments are for example preferably possible: an outer diffuser part AD with the following design: at 0 percent of the length L—circular (rotationally symmetrical); at 30 percent of the length L—square (not rotationally symmetrical); at 60 percent—circular (rotationally symmetrical); at 100 percent—square (not rotationally symmetrical); or an inner diffuser part ID which, in any cross section, is polygonal with a number of corners other than four, in particular is pentagonal.

By contrast to diffusers which are used downstream of gas turbines, the flow of which, under the action of the final guide wheel provided there, no longer exhibits swirl, the invention extends to include in particular diffusers 3 which are used behind fans 2 without a guide wheel, wherein the fans 2 generate swirl in the gas flow.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A fan arrangement comprising a fan and a diffuser disposed downstream of the fan, the diffuser comprising:

an inlet opening and an outlet opening for a gaseous medium which flows entirely through a diffuser interior (I) in an axially oriented main flow direction (S) of an air flow from the inlet opening to the outlet opening;

an outer housing forming an outer diffuser part (AD) of the diffuser interior (I) and which delimits the diffuser interior to the outside;

an inner housing forming an inner diffuser part (ID) of the diffuser interior (I) and which delimits the diffuser interior to the inside such that the diffuser interior (I) is entirely formed between the inner and outer housings, the inner housing and outer housing having approximately the same length (L);

wherein the diffuser has load-bearing shaped rings which surround the inlet opening and the outlet opening, and wherein the load-bearing shaped rings are connected to one another via supporting struts;

wherein the inner diffuser part (ID) is concentrically arranged to the outer diffuser part (AD), a cross section of the outlet opening is larger than a cross section of the inlet opening, and a cross sectional area of the diffuser interior (I) continuously increases from the cross section of the inlet opening to the cross section of the outlet opening;

wherein along the main flow direction (S), the cross section of the diffuser interior (I) continuously changes from a circular shape to a non-circular shape along a longitudinal axis (X-X) so as to convert dynamic pressure into static pressure;

wherein the inner diffuser part (ID) has, in at least one section perpendicular to the main flow direction (S), a non-circular cross section about the longitudinal axis (X-X), wherein the diffuser is fastened to at least one static part of the fan by fastening means or by means of non-positively locking or positively locking connections.

2. The fan arrangement of claim 1, comprising a construction composed of a plurality of individual diffuser parts which are fastened to one another.

3. The fan arrangement of claim 2, wherein at least one of the outer or inner diffuser parts (ID, AD), is composed of originally planar plates which are bent and connected to one another.

4. The fan arrangement of claim 1, wherein the load-bearing shaped rings and supporting struts form a load-bearing structure of the diffuser defining a framework spanned by a thin material composed of plastic or sheet metal.

5. The fan arrangement of claim 1, wherein a surface profile of the diffuser is dimensioned according to the formula $A2/A1 \approx -0.45^* (L/D1)^2 + L/D1 + 1$, where A1 is the area through which flow passes at the diffuser inlet opening, A2 is the area through which flow passes at the diffuser outlet opening, and D1 is the fan diameter.

6. The fan arrangement of claim 1, wherein a hydraulic diameter ($d_{hydr}$) of the diffuser is dimensioned according to the formula $d_{hydr}/L \approx 1.55^*(L/D1)^{-0.82}$, where D1 is the fan diameter.

7. The fan arrangement of claim 1 , the fan including a motor having a downstream outer edge, wherein the inner diffuser part (ID) extends longitudinally to the downstream outer edge and is connected thereto to delimit the diffuser interior to the inside.

8. A fan arrangement comprising and a fan and a diffuser disposed downstream of the fan, the diffuser comprising:

an inlet opening and an outlet opening for a gaseous medium which flows entirely through a diffuser interior (I) in an axially oriented main flow direction (S) of an air flow from the inlet opening to the outlet opening;

an outer housing forming an outer diffuser part (AD) and enclosing the diffuser interior (I);

an inner housing forming an inner diffuser part (ID) of the diffuser interior (I) so as to delimit the diffuser interior (I) along with the outer housing such that the diffuser interior (I) is entirely formed between the inner and outer housings, the inner housing and outer housing having approximately the same length (L);

wherein the diffuser has load-bearing shaped rings which surround the inlet opening and the outlet opening, and wherein the load-bearing shaped rings are connected to one another via supporting struts;

wherein the inner diffuser part (ID) is concentrically arranged to the outer diffuser part (AD), a cross section of the outlet opening is larger than a cross section of the inlet opening, and a cross sectional area of the diffuser interior (I) continuously increases from the cross section of the inlet opening to the cross section of the outlet opening;

wherein along the main flow direction (S), the cross section of the diffuser interior (I) continuously changes from a circular cross section at the inlet opening to a non-circular cross section at the outlet opening so as to convert dynamic pressure into static pressure; wherein at least one of the outer diffuser part (AD) and the inner diffuser part (ID)

is shaped to render the cross section of the diffuser interior (I) rotationally asymmetrical at at least one point;

wherein the diffuser is fastened to at least one static part of the fan by fastening means or by means of non-positively locking or positively locking connections.

9. The fan arrangement of claim 8, wherein the non-circular cross section of at least one of the outer diffuser part (AD) or the inner diffuser part (ID) is of polygonal basic shape.

10. The fan arrangement of claim 9, wherein the non-circular cross section of at least one of the outer diffuser part (AD) or the inner diffuser part (ID) is of square basic shape.

11. The fan arrangement of claim 8, wherein at least one of the inner housing, or the outer housing is composed of plastic and is produced by primary forming or shaping processes.

12. The fan arrangement of claim 11, wherein mechanically highly loaded regions of at least one of the inner housing or the outer housing are reinforced by at least one of the load-bearing shaped rings and supporting struts.

13. The fan arrangement of claim 11, wherein at least one of the inner housing, or the outer housing is composed of plastic and is produced by injection molding, extrusion, rotary molding, foaming, vacuum deep-drawing, or blow molding.

14. The fan arrangement of claim 8, wherein the diffuser interior (I) is lined with a sound-deadening material with a free surface of the sound-deadening material on a side of at least one of the inner housing or the outer housing, the sound-deadening material facing toward the main flow (S) and forming a diffuser wall acting on the air flow.

15. The fan arrangement of claim 14, wherein the sound-deadening material is applied to a diffuser outer surface, which faces away from the main flow (S) of the outer housing.

16. The fan arrangement of claim 14, wherein at least one of the outer diffuser part (AD) or the inner diffuser part (ID) is at least in part made of the sound-deadening material.

17. The fan arrangement of claim 8, wherein a surface profile of the diffuser is dimensioned according to the formula $A2/A1 \approx 0.45^* (L/D1)^2 + L/D1 + 1$, where A1 is the area through which flow passes at the diffuser inlet opening, A2 is the area through which flow passes at the diffuser outlet opening, and D1 is the fan diameter.

18. The fan arrangement of claim 8, wherein a hydraulic diameter ($d_{hydr}$) of the diffuser is dimensioned according to the formula $d_{hydr}/L \approx 1.55^*(L/D1)^{-0.82}$,where D1 is the fan diameter.

19. The fan arrangement of claim 8, the fan including a motor having a downstream outer edge, wherein the inner diffuser part (ID) extends longitudinally to the downstream outer edge and is connected thereto to delimit the diffuser interior to the inside.

* * * * *